United States Patent [19]

Yazidjian

[11] 4,357,908

[45] Nov. 9, 1982

[54] STEAM GENERATOR WITH PRE-HEATING

[75] Inventor: Jean-Claude Yazidjian, Bougival, France

[73] Assignee: Framatome, Courbevoie, France

[21] Appl. No.: 235,882

[22] Filed: Feb. 19, 1981

[30] Foreign Application Priority Data

Feb. 29, 1980 [FR] France ..... 80 04533

[51] Int. Cl.[3] ..... F22B 1/02

[52] U.S. Cl. ..... 122/32; 122/34; 122/488

[58] Field of Search ..... 122/32, 34, 488

[56] References Cited

U.S. PATENT DOCUMENTS

| | | | |
|---|---|---|---|
| 3,329,129 | 7/1967 | Sandri | 122/34 |
| 3,651,789 | 3/1972 | Giardina | 122/32 |
| 3,885,621 | 5/1975 | Slebodnick | 122/32 |
| 3,906,905 | 9/1975 | Andrieu et al. | 122/34 |
| 4,098,329 | 7/1978 | Culver | 122/32 |
| 4,131,085 | 12/1978 | McDonald | 122/32 |
| 4,148,281 | 4/1979 | Stoll et al. | 122/32 |
| 4,200,061 | 4/1980 | Sterk et al. | 122/32 |
| 4,261,300 | 4/1981 | Gross et al. | 122/32 |
| 4,308,914 | 1/1982 | Ruhe et al. | 165/160 |

*Primary Examiner*—Henry C. Yuen

*Attorney, Agent, or Firm*—Pollock, Vande Sande & Priddy

[57] ABSTRACT

A steam generator having cold branch and hot branch zones defined, inside the secondary envelope, by vertical partitions separating the cold limbs from the hot limbs, and outside the secondary envelope by a skirt surrounding a portion of the latter on the cold branch side, forming therewith a space closed on its sides and at its lower portion while leaving a passage to the cold branch zone from the inside of the envelope. The space is open at the top so that recycled water can return to the bundle of U-tubes through both zones, but secondary feed water circulates for the most part in the cold branch zone. Recycled water may be distributed between the cold and hot branch zones, and the pressure in these zones may be balanced at the level of a horizontal, perforated tubular plate.

12 Claims, 15 Drawing Figures

STEAM GENERATOR WITH PRE-HEATING

BACKGROUND OF THE INVENTION

The invention relates to a steam generator, which can be used, for example, in a nuclear installation, for the production of electricity or for naval propulsion.

A steam generator of conventional type comprises a cylindrical outer vessel with a vertical axis, resistant to pressure and closed at each end by a dome. A horizontal tubular plate is arranged inside the vessel, fast to the latter and defining with the lower dome a chamber separated into two collectors, for the intake and discharge, respectively, of a primary heat transfer fluid. A bundle of U-shaped tubes is mounted on the tubular plate. Each U-tube has a hot limb which communicates with the intake manifold and a cold limb which communicates with the discharge manifold, the group of hot limbs constituting the hot branch and the group of cold limbs constituting the cold branch. A secondary envelope surrounds the bundle without being supported on the tubular plate and defines an annular space with the outer vessel. A water intake device is provided for supplying the annular space with secondary water. This secondary water reascends along the tubes of the bundle and is vaporized in contact therewith. In the upper part of the vessel is a set of separators; the vapor produced is removed through an opening formed in the upper dome. The water flowing from the separator, called recycled water, returns to the tubular plate by using the annular space comprised between the outer vessel and the secondary envelope, before reascending again along the bundle of U-shaped tubes. With this recycled water is mixed a feed water which comes from the intake device referred to above. This intake device is placed in the upper part of the steam generator in order that the mixture of feed water and recycled water may be homogeneous before its entry into the tubular bundle.

The conventional type of generator that has just been described has the drawback that the primary-secondary exchange surface is not optimally used; consequently, the thermal efficiency of the whole of the generator is not at a maximum.

To overcome this drawback, i.e., to attempt to increase the efficiency of the generator, provision has been made for pre-heating the feed water before mixing it with the recycled water. This pre-heating permits a better use of the exchange surface and an increase in the thermal efficiency of the whole of the generator.

From a theoretical point of view, the maximum efficiency is reached when the feed water is brought into the immediate vicinity of the tubular plate and then reascends along the cold branch of the U-tubes, in contact with which it must be reheated over a certain distance, called the preheating zone. The feed water is only mixed with the recycled water coming from the separators at the outlet from the preheating zone.

However, this arrangement has several drawbacks. In particular, due to the fact that the feed water must not be mixed with the recycled water before having been pre-heated, the intake and guide structures for this water must be relatively fluid-tight. In addition, due to the fact that under low load or during certain transient periods of operation (introduction of emergency water), the temperature of the feed water decreases. This water can then initiate in the structures with which it comes into contact (tubes, tubular plate, pressure vessel) unacceptable thermal stresses.

To overcome these drawbacks, several solutions have been proposed, among which are those which consist of incorporating a support in temperature of the feed water or of providing a secondary feed at the top of the steam generator.

These two solutions, however, lead to encumbrance of the operation and of the control of the steam generator.

To reduce the heat stresses in the tubular plate, the zone where the feed water enters the bundle may be moved away from this plate while keeping it in the bottom part. This is the subject, for example, of French Pat. No. 2,191,704 in the name of SIEMENS A. G.

This geometry manifests itself with respect to the theoretical case envisaged above by a lowering in the saturation pressure delivered by the steam generator and by complex structures to be installed in the lower part of the apparatus.

It has also been proposed to create a buffer zone traversed by the recycled water above the tubular plate.

It would be possible, for example, to refer to French patent application No. 2,285,573 in the name of WESTINGHOUSE ELECTRIC CORPORATION. In the buffer zone, the tubular plate, on the cold branch side, is swept by the recycled water. This recycled water is guided by a very slightly permeable plate, which is in fact constituted by the floor of the pre-heater, this pre-heater and the feed water intake device being situated at the lower part of the steam generator.

However, the floor of the pre-heater may create bending stresses in the tubes (pressure deformation of the tubular plate, differential expansion of the tubular plate and of the floor of the pre-heater), and in addition renders the tubing operation difficult on account of its having a lower permeability than the cross-bracing plates of the tubular bundle, and of its proximity to the tubular plate.

On the other hand, this floor cannot be perfectly fluid-tight, so that a portion of the feed water passes through it and is directed to the hot branch: this reduces the overall performance of the steam generator.

In addition, the introduction of feed water into the bundle without mixing with recycled water, whatever the load, makes delicate the establishment of the sizes of the pre-heater structures since the latter must respond to two contradictory requirements:

1. It must accommodate considerable variations in temperature, which necessitates small thicknesses.

2. It must limit in an accident situation (rupture of tubing, water-hammer) deformations which could place in danger the primary-secondary barrier constituted by the tubes. It is hence necessary to provide a rigid assembly.

Finally, the steam generator of the type described in the French patent application No. 2,285,573 has the drawback of comprising a more restricted space for the tubes for a given diameter of the pressurized envelope, a part of the space being occupied by the pre-heater.

French patent application No. 2,387,417 in the name of the Commissariat a l'Energie Atomique is also known, this describing à steam generator not having the aforementioned drawbacks. In this generator, all of the feed water is mixed with the recycled water and sent to the cold branch of the tubular plate through a central caisson situated between the limbs of the U-tubes, the water being channelled to the caisson by two flat rings of elliptical shape.

However, this construction leads to a very complex structure.

It is an object of the invention, therefore, to provide a novel steam generator provided with a pre-heating device but not having the drawbacks of the prior art.

SUMMARY OF THE INVENTION

The invention is applicable to any steam generator of conventional type, conforming to the description given above.

According to the invention, the steam generator is separated into two zones, a cold branch and a hot branch zone, the separation being effected, on the one hand, inside the secondary envelope, by vertical partitions separating the cold limbs and from the hot limbs, on the other hand outside the secondary envelope, by a skirt surrounding a portion of the secondary envelope, on the side of the cold branch, and constituting with said envelope a space closed on the sides and at its lower part, while leaving a passage to the cold branch zone from the inside of the envelope, and open at its upper part, so that the secondary water recirculated after passage in the separators, called recycled water, can return to the bundle of U-tubes both through the cold arm zone and through the hot arm zone, but the secondary feed water, arriving through an inlet device situated at the upper part of the generator circulates for the essential part of its flow in the cold branch zone.

In addition, the generator according to the invention includes means for distributing recycled water between the two zones, cold branch and hot branch, and for balancing, at the level of the tubular plate, pressures in these two zones. It would be possible to use, on the one hand, a distributing collar placed in the space comprised between the secondary envelope and the skirt, perpendicular to the direction of the current of secondary water from the cold arm zone; on the other hand, a distributing plate placed inside the secondary envelope in each of the zones, cold arm and hot arm, perpendicular to the direction of the U tubes, these two plates being generally of different permeability.

In a preferred embodiment of the invention, the skirt is situated at a constant distance from the secondary envelope, defining with the latter a space whose section through a plane parallel to the tubular plate is a ring sector whose angle can vary with the sectional plane. The skirt extends vertically from the tubular plate to the feed water inlet device; its sides are folded back towards the secondary envelope and welded to this envelope, while its lower part is connected to the tubular plate by a semi-fluid-tight connection limiting leakages but enabling movements of the skirt with respect to the plate so as to accommodate the relative deformations due to pressure and to expansions.

In a particular embodiment of the invention, the skirt is merged with the outer vessel, except for the edges which are constituted by two vertical partitions extending between the outer vessel and the secondary envelope.

Preferably the vertical partition separating the cold arm zone from the hot arm zone inside the secondary envelope extends from the tubular plate to a height at least equal to the height necessary for pre-heating the feed water; it is welded on the sides inside the secondary envelope and connected to the tubular plate by a semi-fluid-tight partition.

To effect the semi-fluid-tight connections, it is possible, for example, to use rails fast to the tubular plate, in which the lower portions of the skirt and of the vertical partition are engaged. If, at the level of the tubular plate, the cross-section of the skirt is a ring sector of 180°, the folded back sides of the skirt can be engaged in the same rectilinear rail as the vertical partition.

In a preferred embodiment of the semi-fluid-tight connections, the lower portion of the skirt can be engaged in a rail fast to the outer vessel and not to the tubular plate, in order to reduce the stresses in this plate.

Preferably, the secondary feed water is sent for the whole of its flow into the cold arm zone.

BRIEF DESCRIPTION OF THE DRAWINGS

In order that the invention may be more clearly understood, it will now be described with reference to several embodiments, chosen purely by way of example and shown in the accompanying drawings.

FIGS. 8, 9, 10 and 11 show various embodiments of the connecting means of the lower portion of the skirt and of the vertical partition with the tubular plate.

FIG. 11 shows a connection system with spring-type seals.

In all the Figures, the corresponding elements bear the same reference numerals.

DETAILED DESCRIPTION OF AN EMBODIMENT

Figure 1:
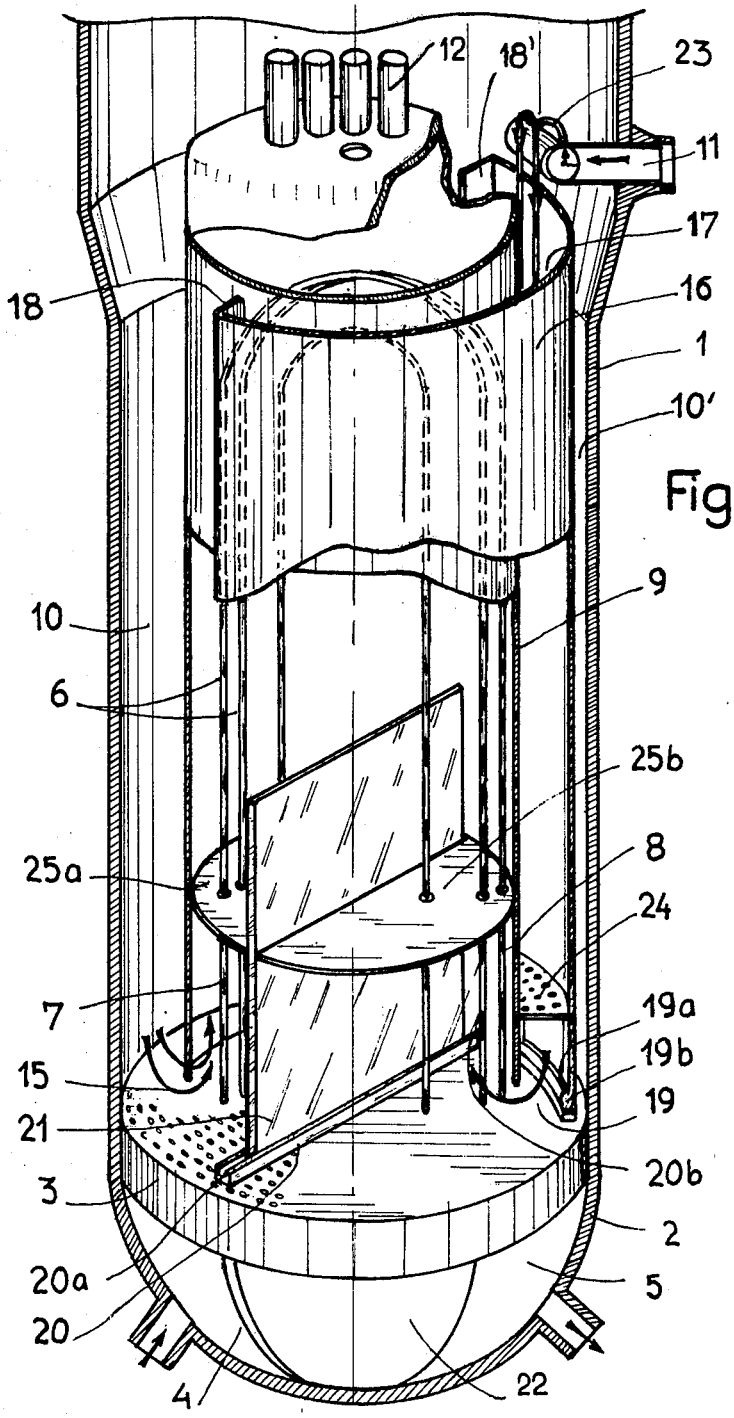
FIG. 1 shows a view of a first embodiment of the generator according to the invention.
Figure 2:
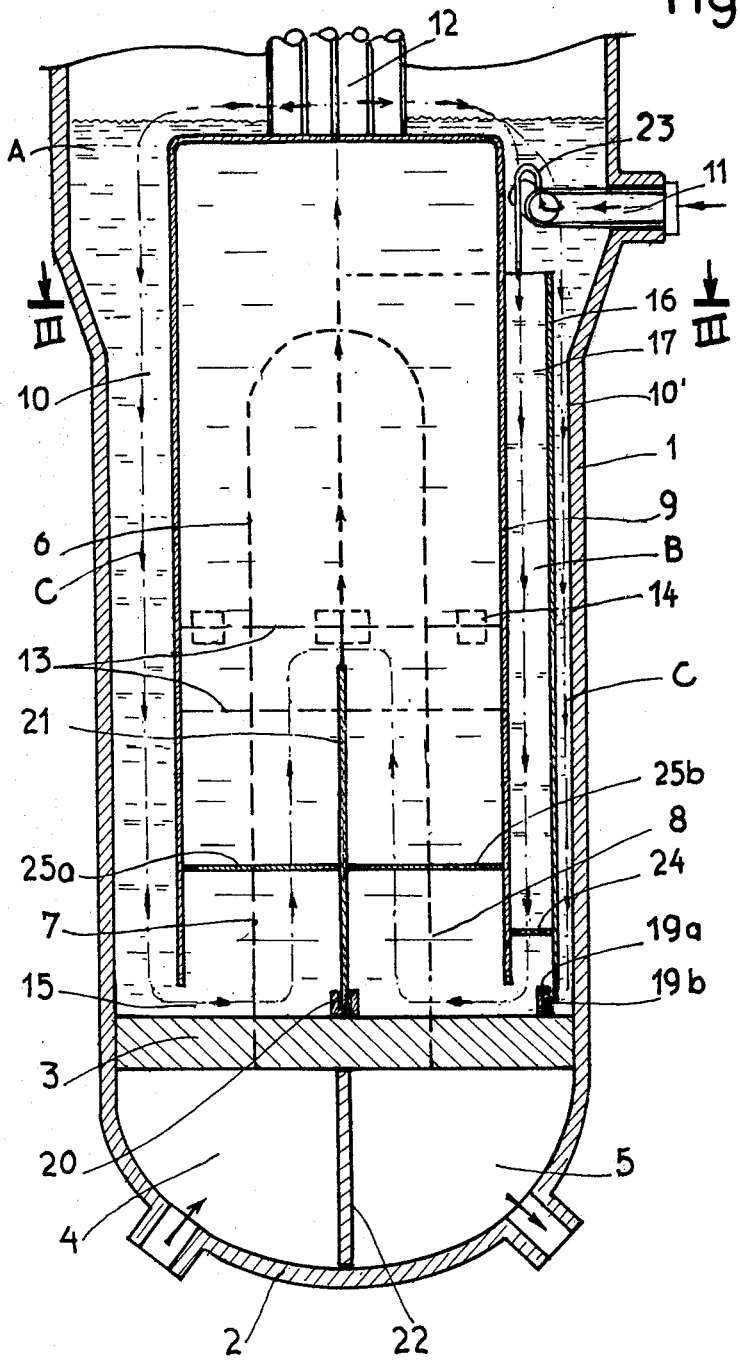
FIG. 2 shows a section, through a plane perpendicular to the tubular plate and to the vertical partition, of the generator of FIG. 1.
Figure 3:
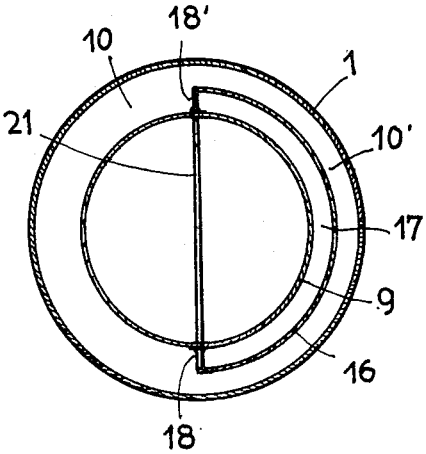
FIG. 3 shows a section through a plane parallel to the tubular plate, at the level of the upper portion of the skirt, of the steam generator of FIG. 1 (section along the line III—III).

Reference will first be made to FIGS. 1, 2 and 3.

The steam generator shown in FIGS. 1, 2 and 3 comprises a cylindrical outer vessel 1 of vertical axis, pressure resistant, closed at each end by a dome. The upper dome has not been shown but it is possible to see the lower dome 2. A horizontal tubular plate 3 is arranged inside the vessel 1, fast to the latter and defining with the lower dome 2, a chamber separated into two manifolds 4 and 5, the manifold 4 being an intake manifold and the manifold 5 a discharge manifold for a primary heat transfer fluid; this primary fluid may, for example, come from a nuclear power plant reactor.

U-tubes, 6, grouped in a bundle, are mounted on the tubular plate 3 and each has a hot limb 7 which communicates with the intake manifold 4 and a cold limb 8 which communicates with the delivery manifold 5. The group of hot limbs 7 constitutes the hot arm and the group of cold limbs constitutes the cold arm.

A secondary envelope or jacket 9 engirdles the bundle of tubes 6 without being supported on a tubular plate 3 and defines an annular space 10 with the outer vessel.

An inlet device 11 for feeding the annular space 10 with secondary water is provided at the upper portion of the generator:

This water is intended to descend to the tubular plate 3, then to reascend along the tubes 6 and to be reheated and then vaporized in contact therewith. In the upper portion of the vessel 1 is provided a group of separator-dryers 12 intended to separate the steam obtained in the upper portion of the tubes. This steam is then removed through an opening formed in the upper dome (not shown).

In FIG. 2 are shown the bracing plates 13 which hold the bundle of tubes 6. These plates 13 and the secondary envelope 9 are blocked in translation with respect to the outer vessel 1 by blocks 14.

Space 15 is provided between the secondary jacket 9 and the tubular plate 3 so that the secondary fluid may enter the bundle.

A skirt 16 engirdles a portion of the secondary envelope 9 on the side of the cold arm and constitutes with the envelope 9 a space 17 closed on the sides and at its lower portion. The space 17 constitutes the return circuit for the recycled water to the cold arm or cold arm water return, while the annular space 10 comprised between the pressurized vessel 1 and the secondary envelope 9, on the one hand, and the space 10' comprised between the vessel 1 and the skirt 16, on the other hand, define the hot arm water return duct. The sides 18 and 18' of the skirt 16 are folded back on the secondary jacket 9 and welded to the latter, thus avoiding the passage of fluid from the cold arm water return to the hot arm water return duct.

The lower portion of the skirt 16 is connected to the tubular plate 3 by a semi-fluid-tight connection limiting leakages. This connection is here constituted by the groove **19*a* of a semi-circular rail 19 welded to the tubular plate in which a rim 19*b* of the lower portion of the skirt 16 is fitted. In the same way, the lower portion of the sides 18 and 18' is engaged in the ends 20*a* and 20*b* of a rectilinear rail 20**.

Within the secondary envelope 9, a vertical partition 21 separates the cold limbs 8 from the hot limbs 7. This vertical partition 21 is engaged in the rectilinear rail 20. The plate 21 is in fact placed in the extension of the partition plate 22 separating the manifolds 4 and 5. It is welded to the secondary jacket 9 and extends vertically to a height at least equal to the height necessary for preheating the feed water. The partition 21 can thus also prevent cross-flows in the bundle before any feed water is preheated.

A feed water intake ramp is fixed in the nozzle 11 and is provided with J-tubes 23, whose openings permit flow into the upper portion of the cold arm water return duct 17.

A collar 24 provided with orifices is situated at the lower portion of the space 17 and is designed to create a pressure drop therein. This collar 24 also permits homogenous supply of the cold arm.

Distributing plates **25*a* and 25*b* whose permeabilities are different are situated inside the secondary jacket 9**, one on the hot arm side and the other on the cold arm side, perpendicular to the direction of the U-tubes. These plates have the main function of assuring good scavenging of the tubular plate in order to avoid the creation of zones of low velocity of the water close to the tubular plate. They contribute also to balancing the pressures at the bottom of the bundle between the cold arm and the hot arm and enable flows of water from one arm to the other to be avoided.

The steam generator according to the invention operates in the following way:

The primary heat transfer fluid flows upwards in the tubes on the hot arm side and redescends on the cold arm side.

The secondary water flowing upwards is partially vaporized in the bundle of tubes to a steam titer of 20 to 40%. The emulsion thus produced is directed to a separation-drying unit assuring the separation of the water and the steam and the drying of the latter. The separated water, called recycled water, returns to the base of the bundle along the circuits shown by an arrow in FIG. 2, which comprises a common zone A, a cold arm water return circuit B and a hot arm water return circuit C. A portion of the secondary recycled water is mixed with the feed water coming from the intake device 11, whereas the remaining portion enters the hot arm directly, and the whole is again vaporized. In operation, a single water level is established at the head of the circuit in the vicinity of the base of the separators 12.

Whereas, in the prior art, the recycled water was uniformly distributed in a space comprised between the outer vessel and the secondary jacket, here, at full load, a considerable fraction of the recycled water, more than 50%, is directed to the hot arm of the bundle through the hot arm water return duct, i.e., through spaces 10 and 10', whereas the remaining fraction of recycled water is mixed in the cold arm water return duct 17 with the whole of the feed water coming from the nozzle 11, before reaching the tubular plate 3 and the preheating zone (i.e., the cold arm zone comprised inside the secondary envelope 9). This fractioning of the recycled water results from the pressure drop effect created on the one hand by the collar 24, and on the other hand by the difference in permeability of the distributing plates **25*a* and 25*b*** situated in the hot arm and the cold arm, respectively.

With respect to certain solutions of the prior art, where only the feed water enters the cold arm of the bundle of U-tubes, the solution according to the present invention results in a drop in the pressure delivered by the steam generator, due to the reduction in the primary-secondary temperature separation. However, this reduction in the separation of the temperatures is partially compensated by a rise in the transfer coefficient in the secondary film due to an increase in the total flow rate passing through the hot arm zone of the bundle, resulting in very satisfactory efficiency.

The collar 8 and the distributing plates **25*a* and 25*b*** are adjusted so as to obtain optimum distribution of the pressure drops, i.e., a distribution for which, at the rated point, hence under full load, the fraction of recycled water directed to the hot arm is close to 100%.

Upon reductions in power, which result in reductions in the flow rate and the temperature of the feed water, the relative proportion of recycled water/feed water increases naturally in the cold arm water return duct, which has the effect of compensating for the drop in temperature of the feed water. Thus, the temperature of the mixture arriving at the tubular plate remains substantially constant both at full load and at weak load.

Figure 4:
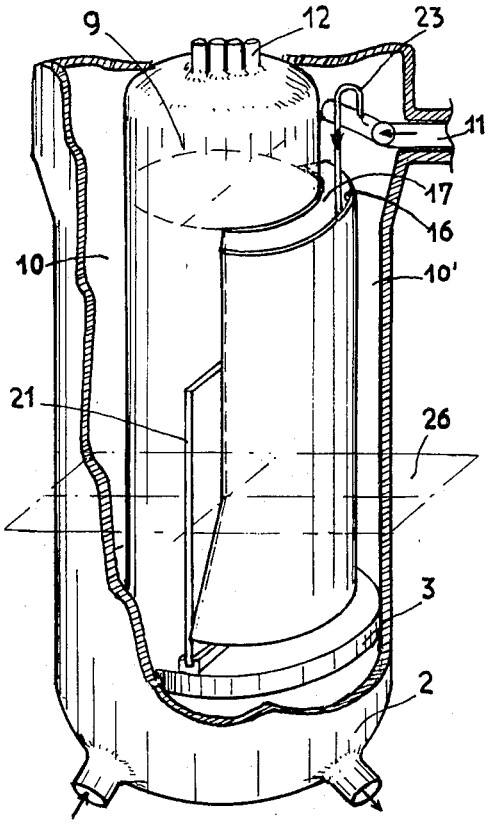
FIG. 4 shows a second embodiment of the skirt according to the invention, in a view similar to that of FIG. 1.
Figure 5:
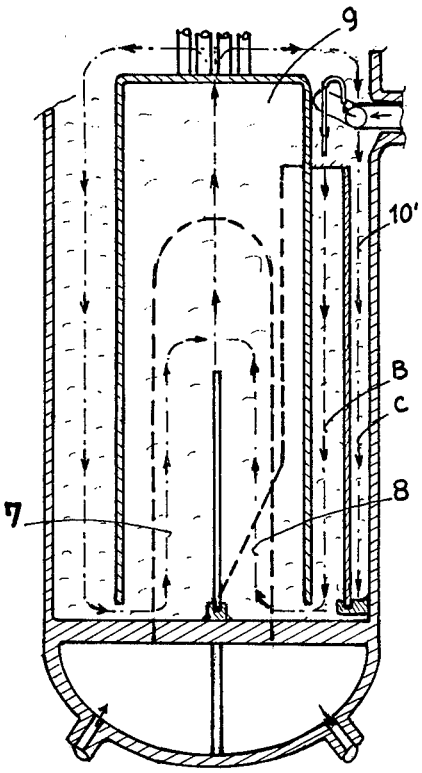
FIG. 5 shows the embodiment of FIG. 4, seen in a section similar to that of FIG. 2.
Figure 6:
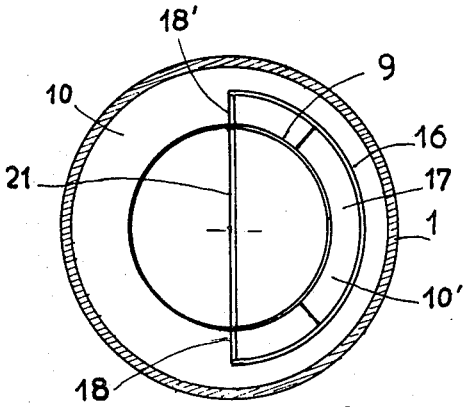
FIG. 6 shows the embodiment of FIG. 4, seen similarly to that of FIG. 3.

Reference will now be made to FIGS. 4, 5 and 6, which show a second embodiment of the skirt 16.

In these Figures, the main purpose is to show the skirt 16, the other parts of the generator being similar to those of FIGS. 1, 2 and 3.

In the case of FIGS. 4, 5 and 6, the cross-section of skirt 16 through a plane parallel to the tubular plate is a ring sector, but this ring sector has an angle which varies with the cross-sectional plane. From the upper portion of the steam generator to an intermediate plane 26, the angle of the ring sector is less than 180°, whereas, from the intermediate plane 26 to the level of the tubular plate 3, the ring sector increases continuously from its value at the level of the intermediate plane 26 up to 180°.

Still other possibilities could be conceived, provided that the cross-section of the skirt is always a ring sector.

Figure 7:
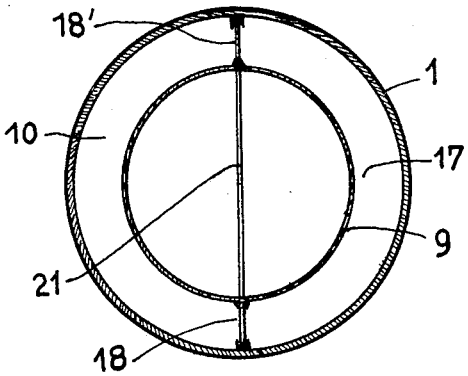
FIG. 7 shows a third embodiment of the skirt, seen similarly to FIG. 3.

In a limiting case, shown in FIG. 7, the skirt 16 is situated at a distance from the secondary envelope 9 which is equal to the distance between the outer vessel 1 and the secondary envelope 9; this amounts to saying that the skirt 16 is merged with the outer vessel 1, with the exception of the sides 18 and 18'. In fact, the skirt is constituted only by the sides 18 and 18', that is to say by a simple set of two vertical partitions extending between the vessel 1 and the envelope 9 in extension of the vertical partition 21.

FIGS. 3, 9, 10 and 11 show examples of semi-fluid-tight connections, between the lower portions of the skirt and the vertical partition 21 and the tubular plate 3.

Figure 8A:
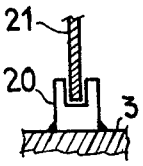
FIGS. 8*a*, 8*b* and 8*c* show the lower portions engaged in the rails.
Figure 8B:
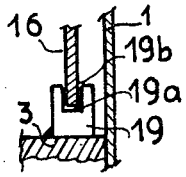
Figure 8C:
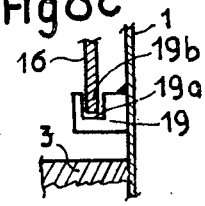

FIG. 8 shows the lower portions engaged in the rails. The vertical partition 21 is engaged in the rail 20. The lower portion of the skirt, 19*b*, is engaged in the groove 19*a* of a rail 19. The rail 19 then may be fixed either directly to the tubular plate or, preferably, to the outer vessel, as shown in FIG. 8*c*.

Figure 9A:
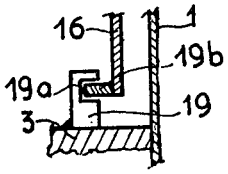
FIGS. 9*a* and 9*b* show the lower portion engaged in the labyrinth seals.
Figure 9B:
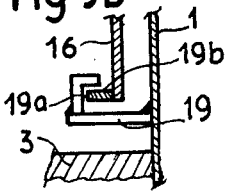

In FIG. 9, the semi-fluid-tight connections are effected by means of labyrinth seals fast either to the tubular plate (FIG. 9*a*), or directly to the outer vessel 1 (FIG. 9*b*).

Figure 10A:
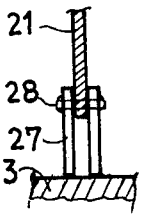
FIGS. 10*a* and 10*b* show a connection system with butt plates.
Figure 10B:
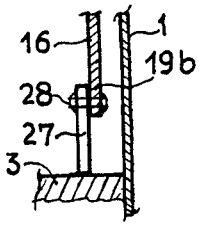

FIG. 10 shows a connecting system for the lower portions by means of butt-plates. The butt-plates 27 are fixed by sectors to the lower portions of the vertical partition 21 or to the skirt 16 by means of bolts 28. On assembly the play between the butt-plates and the tubular plate is eliminated.

Figure 11:
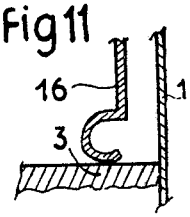

As for FIG. 11, it shows a connection formed by means of a spring type seal.

The present invention comprises numerous advantages.

In particular, it combines, from the design point of view, the advantages of the conventional steam generator with a toric feed and recycled water distribution, and, from the performance point of view, the advantages of steam generators with an integral preheater such as those which have been described above.

The present invention enables the production of a steam pressure higher than that of a conventional steam generator and close to that of steam generators with integral preheater, while being of very simple construction.

The invention resolves the problems of thermal shock at the level of the tubular plate and at the level of the outer vessel. In fact, the introduction of the feed water is effected at the upper part of the generator, i.e., remote from the tubular plate, and this water is mixed on the cold arm side with a hotter fraction of recycled water; this recycled water fraction increases at low load, i.e., when the temperature and the feed water flow rate diminish. The temperature of the secondary water arriving at the secondary plate is hence practically constant. As for the pressurized vessel 1, it is held at a uniform temperature since it is always in contact with the recycled water contained in the annular spaces 10 and 10', and not with the feed water. It may be added that the consequences of a rupture of the supply piping on the integrity of the U-tubes and the structure of the preheater are less serious than in the case of generators including an integral preheater, as described at the beginning of the description, since the pressure effects are damped.

In the steam generator according to the invention, no difficulty is encountered such as those which are encountered in generators provided with preheaters or with caissons whose dimensioning is delicate. In addition, the difficulties connected with the presence of a preheating floor are eliminated.

It may be added also that the sealing requirements in the zone of the tubular plate are limited by reason of the regulation of the hot arm-cold arm pressures introduced by the distributing plates. The cross-flows inside the secondary envelope at the top of the preheating zone are also minimized.

Another important advantage of the invention resides in the fact that its structure is very simple.

Of course, the invention is not limited to only the embodiments which have been decribed by way of example, but it applies also to all other embodiments which differ only in detail, modifications of construction or the use of equivalent means.

Thus, it is not necessary for all the feed water to flow through the annular space comprised between the secondary envelope 9 and the skirt 16, but a part of this feed water could flow in annular ducts 10 and 10'. Certainly, the proportion of feed water which would thus circulate in the hot arm zone should remain within small proportions.

It would also be possible to place the collar 24, not at the lower portion of the generator but rather at its upper portion. Thus, this collar would be accessible on shutdowns; it would also be possible to provide obturatable orifices and, on shutdown, to regulate the distribution of the pressure drops. It would be possible, besides, to carry out this regulation, to modify the permeability of the bracing plates 13 situated in the preheating zone, i.e., below the top of the vertical partition 21.

As regards the distributing plates 25*a* and 25*b*, it may be added that the latter can be situated in different planes.

I claim:

1. Steam generator comprising (a) a pressure resistant, cylindrical outer vessel with a vertical axis;

(b) an upper dome and a lower dome closing said vessel at each end thereof;

(c) a horizontal tubular plate arranged inside said vessel, fast to the latter and defining with said lower dome a chamber separated into an intake manifold and a discharge manifold, respectively, for heat transfer primary fluid;

(d) a bundle of U-tubes mounted on said tubular plate, each having a hot limb which communicates with said intake manifold and a cold limb which communicates with said discharge manifold, the group of hot limbs constituting a hot arm and the group of cold limbs constituting a cold arm;

(e) a secondary envelope engirdling said tube bundle without being supported on said tubular plate and defining an annular space with said outer vessel;

said intake device for feeding said annular space with secondary water intended to reascend along tubes of said bundle and to be vaporized on contact therewith; and, (g) in the upper portion of said vessel, a group of separators and an opening formed in said upper dome for the removal of the steam produced;

(h) said steam generator being separated into a cold arm zone and a hot arm zone, the separation being effected inside said secondary enevelope by a vertical partition separating said hot limbs from said cold limbs, and outside said secondary envelope by a skirt encircling a portion of said secondary envelope on the side of said cold arm and constituting with said envelope line a spaced closed on the sides and at its lower portion, while leaving a passage to said cold arm zone from the inside of said envelope, and open at its upper portion, so that the secondary water recycled after passage in said separator can return to said bundle of U-tubes through both said cold arm zone and said hot arm zone, but that the secondary feed water, arriving through said intake device situated at the upper portion of said generator, flows for the essential part of its flow, in said cold arm zone.

2. Steam generator according to claim 1, comprising means for distributing the recycled water between said cold arm and hot arm zones, and for balancing, at the level of said tubular plate, the pressures in these two zones.

3. Steam generator according to claim 2, comprising a distributing collar in the space between said secondary envelope and said skirt perpendicular to the direction of the secondary water flow from said cold arm zone.

4. Steam generator according to claim 2, wherein, inside said secondary envelope, each of said cold arm and hot arm zones comprises a distributing plate perpendicular to the direction of said U-tubes, the two plates being of different permeability.

5. Steam generator according to claim 1, wherein said skirt is situated at a constant distance from said secondary envelope, defining with the latter a space whose section through the plane parallel to said tubular plate is a ring sector whose angle can vary with the sectional plane, said skirt extending vertically from said tubular plate to said feed water intake device, its sides being folded back to said secondary envelope and welded to said envelope, and its lower portion being connected to said tubular plate by a semi-fluid-tight connection.

6. Steam generator according to claim 5, wherein said skirt is merged with said outer vessel, except for the sides which are constituted by two vertical partitions extending between said outer vessel and said secondary envelope.

7. Steam generator according to claim 1, wherein said vertical partition separating said cold arm zone from said hot arm zone inside said secondary envelope extends from said tubular plate to a height at least equal to the height necessary for preheating the feed water, said partition being welded on the sides to the inside of said secondary envelope and connected to said tubular plate by a semi-fluid-tight connection.

8. Steam generator according to claim 5, wherein the lower portions of said skirt and of said vertical partition are engaged in rails fast with said tubular plate.

9. Steam generator according to claim 8, wherein said vertical partition and said folded back sides of said skirt are engaged in the same rectilinear rail.

10. Steam generator according to claim 5, wherein the lower portion of said skirt is engaged in a rail fast with said outer vessel.

11. Steam generator according to claim 5, wherein the lower portions of said skirt and of said vertical partition are connected to said tubular plate by means of spring type seals.

12. Steam generator according to claim 1, wherein the secondary feed water is sent for its whole flow into said cold arm zone.

* * * * *